United States Patent [19]

Anders et al.

[11] Patent Number: 4,742,810

[45] Date of Patent: May 10, 1988

[54] ULTRASONIC ATOMIZER SYSTEM

[75] Inventors: Klaus Anders, Ostelsheim; Werner Bez, Stuttgart; Arnold Frohn, Stuttgart; Helmut Schwarz, Vaihingen/Enz, all of Fed. Rep. of Germany

[73] Assignee: Robert Bosch GmbH, Stuttgart, Fed. Rep. of Germany

[21] Appl. No.: 72,204

[22] Filed: Jul. 10, 1987

[30] Foreign Application Priority Data

Jul. 23, 1986 [DE] Fed. Rep. of Germany ..... 3624892
Apr. 18, 1987 [DE] Fed. Rep. of Germany ..... 3713253

[51] Int. Cl.[4] ..... F02M 27/00

[52] U.S. Cl. ..... 123/538; 123/590; 239/102.2; 261/DIG. 48

[58] Field of Search ..... 123/590, 538, 536, 537; 239/102.2; 261/DIG. 48

[56] References Cited

U.S. PATENT DOCUMENTS 3,860,173 1/1975 Sata ..... 239/102.2
4,211,199 7/1980 Thatcher et al. ..... 123/590
4,259,021 3/1981 Goudy, Jr. ..... 123/590
4,372,491 2/1983 Fishgal ..... 261/DIG. 48
4,418,672 12/1983 Müller et al. ..... 239/102.2

OTHER PUBLICATIONS

ASME/JSME Thermal Engineering Joint Conference Proceedings-vol. Two, pp. 433–439, published Mar. 20, 1983.

*Primary Examiner*—E. Rollins Cross
*Attorney, Agent, or Firm*—Edwin E. Greigg

[57] ABSTRACT

The ultrasonic atomizer system serves to atomize fuel to be injected into internal combustion engines, thereby forming droplets of identical diameters ($d_T$). The ultrasonic atomizer system includes an atomizer housing having a pressure chamber into which fuel is delivered under pressure by a pump. An ultrasonic vibrator protudes into the atomizer housing. Transport lines that transmit the vibrations lead from the pressure chamber to nozzles on the air intake tubes of the engine. A plurality of injection ports are provided in each of the nozzles and the streams of liquid emerging from the injection ports of each nozzle are made to undergo a monodisperse disintegration by the vibrations of the ultrasonic vibrator to form droplets of equal diameter ($d_T$).

16 Claims, 2 Drawing Sheets

ULTRASONIC ATOMIZER SYSTEM

BACKGROUND OF THE INVENTION

The invention is based on an ultrasonic atomizer system for liquids. Ultrasonic atomizer systems are already known, which are used for instance for the injection of fuel in internal combustion engines, and in which ultrasonic vibrations are used to break up the stream of liquid emerging from the ultrasonic atomizer nozzles into tiny droplets. The diameter of the droplets of liquid produced by the ultrasonic atomizer nozzle varies over a very wide range, which is however, disadvantageous in many applications. For example, if this known ultrasonic atomizer nozzle is used for supplying fuel in internal combustion engines, then because of these varying droplet structures the fuel-air mixture is not optimally prepared, and the mixture is not distributed uniformly to the individual cylinders of the engine. Furthermore, one ultrasonic atomizer nozzle with an ultrasonic vibrator is required for each cylinder of the engine.

OBJECT AND SUMMARY OF THE INVENTION

The ultrasonic atomizer system according to the invention has the advantage over the prior art that the production of even relatively large quantities of fluid as an aerosol, and in particular with monodisperse droplets, that is, droplets of equal diameter, is assured in a simple manner by means of an ultrasonic vibrator at various injection locations. In particular, an ultrasonic atomizer system of this kind serves to generate a homogeneous fuel-air mixture in a mixture forming unit of an internal combustion engine and to distribute fuel uniformly to the individual cylinders of the engine.

In an advantageous feature of the invention, the transport line can be made of an elastic material, and for transmitting the vibrations, a separate metal connecting strand extends from the ultrasonic vibrator to each nozzle.

The invention will be better understood and further objects and advantages thereof will become more apparent from the ensuing detailed description of a preferred embodiment taken in conjunction with the drawing.

DESCRIPTION OF THE PREFERRED EMBODIMENT

Figure 1:
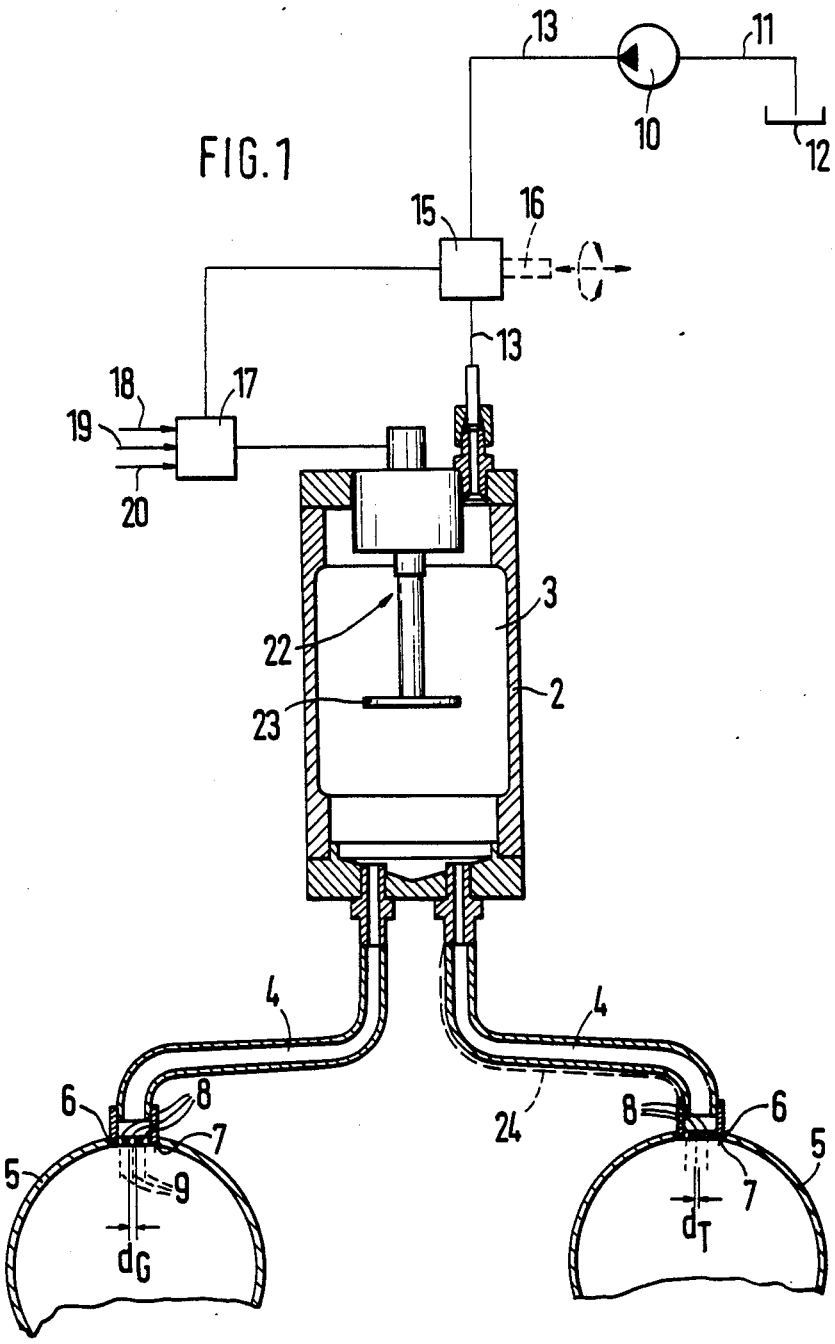
FIGS. 1 and 2, in simplified fashion, show an ultrasonic atomizer system according to the invention.
Figure 2:
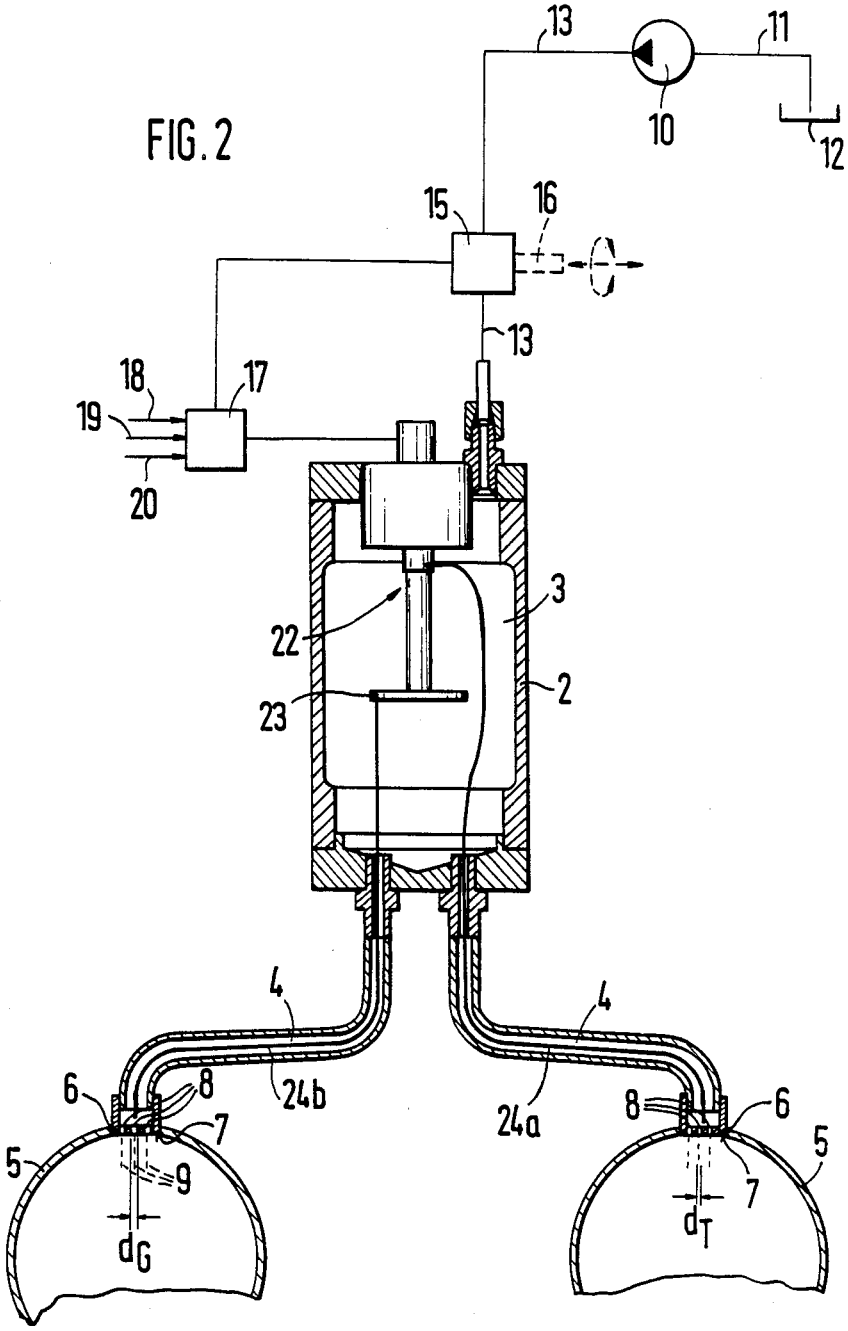

FIGS. 1 and 2 show an ultrasonic atomizer system in schematic form; in the exemplary embodiment shown in the drawings, this system is used for atomizing fuel to form a fuel-air mixture for an internal combustion engine. To this end, the ultrasonic atomizer system has an atomizer housing 2, which surrounds a pressure chamber 3 and from which a plurality of transport lines 4 branch off, each leading to one air intake tube 5, in particular upstream of the inlet valves of the engine. The transport lines 4 discharge via nozzles 6 into the air intake tubes 5, in the end faces 7 of which a plurality of injection ports 8 are provided, each of which have the same diameter $d_G$. The injection ports 8 lead outward from the interior of the nozzle 6 and are made by laser beam drilling, for example. The number of injection ports 8 required is determined on the basis of the maximum quantity of liquid, in the present exemplary embodiment fuel, that is to be ejected or atomized. For forming the fuel-air mixture to be delivered to the engine, not shown, the nozzle 6 is disposed on or in each air intake tube 5 of the engine in such a manner that the flowing aspirated air mixes intensively with the fuel droplets 9 emerging from the nozzles 6, to form a homogeneous fuel-air mixture. The supply of fuel to the ultrasonic atomizer system is effected by a fuel pump 10, which aspirates fuel from a fuel tank 12 via an intake line 11 and pumps it under pressure into a fuel supply line 13 that leads to the atomizer housing 2. In the fuel supply line 13, a fuel metering element 15 may be provided, either between the atomizer housing 2 and the fuel pump 10 or integrated into the atomizer housing 2; in a known manner the fuel metering element includes a fixed or variable throttle restriction, which is actuatable electromagnetically or mechanically via an actuating member 16 in accordance with engine operating characteristics. In a known manner, the actuating member 16 of the fuel metering elements may be rotated or axially displaced, for instance by connection with a throttle valve or air flow rate meter disposed in the air intake tube 5. In the case of electromagnetic actuation of the fuel metering element 15, the triggering is effected by means of an electronic control unit 17, to which engine operating characteristics such as load 18, aspirated air quantity 19, temperature 20 and so forth, converted into electrical signals, can be supplied.

An ultrasonic vibrator 22, for example embodied as a piezoceramic vibrator, is disposed on the atomizer housing 2, protruding with a vibration plate 23 into the pressure chamber 3 and being triggerable by the electronic control unit 17 as a function of engine operating characteristics. Naturally the ultrasonic vibrator 22 can also be integrated into the atomizer housing 2. The fuel located under pressure in the pressure chamber 3 of the atomizer housing 2 flows via the transport lines 4, which transmit the vibrations, to the nozzles 6 and emerges from them via the injection ports 8 in the form of a fine stream of fuel, whereupon the ultrasonic vibrator 22 causes it to disintegrate into droplets, in fact droplets having identical diameters $d_T$. Monodisperse droplets thus enter the air intake tube 5 of the engine and mix with the aspirated air to form a homogeneous fuel-air mixture. The triggering of the ultrasonic vibrator 22 is effected by the electronic control unit 17 in accordance with engine operating characteristics having wavelengths $\lambda$, which cause a disintegration of the streams of fluid emerging from the injection ports 8, forming droplets having identical diameters. The permissible range of the wavelengths $\lambda$ of the vibrations of the ultrasonic vibrator 22 for generating droplets of identical diameters is located between a minimum wavelength $\lambda_{min}$ and a maximum wavelength $\lambda_{max}$. The minimum wavelength $\lambda_{min}$ is determined by the product of the diameter $d_G$ of the injection ports 8 and pi ($\pi$). The maximum wavelength $\lambda_{max}$ for forming droplets having identical diameters is six times the product of the diameter $d_G$ of the injection ports 8 and pi ($\pi$), or in other words six times the minimum wavelength $\lambda_{min}$. The smallest diameter $d_T$ of the monodisperse droplets results with the minimum wavelength $\lambda$min of the ultrasonic vibrator.

The fuel volume $\dot{V}$ per unit of time that is throughput through an injection port 8 is $$\dot{V}=\pi/4(d_G^2 V_G),$$

where $v_G$ is the mean speed of the fuel in the injection port 8. The mean speed $v_G$ of the fuel in the injection port 8 is a function of the pressure drop between the pressure chamber 3 and the air intake tube 5.

The wavelength λ of the vibration imposed on the fuel stream emerging from the injection port 8 is $$\lambda = V_G/f_G,$$

where $f_G$ is the excitation frequency of the ultrasonic vibrator 22.

The identical diameter $d_T$ of all the fuel droplets can be calculated as $$d_T = \sqrt[3]{36/\pi \cdot v/f_G}$$

Taking the above two formulas into account, the diameter of the fuel droplets is $$d_T = \sqrt[3]{1.5 d_G^2 \lambda}.$$

In accordance with the invention, and as shown for the exemplary embodiments, the vibration excitation is effected for all the nozzles 6 at once, centrally in the atomizer housing 2, which in particular is of metal, by means of a single ultrasonic vibrator 22. As in the case of the transport line 4 shown on the left in FIG. 1, the transport lines 4 can be made of a material, for instance a metal such as steel, that transmits the vibrations to the nozzles 6. In another embodiment, as shown for the transport line 4 on the right in FIG. 1, the transport lines 4 can be made of an extensible material, and a metal connecting strand 24, represented by broken lines, extends on the inside or outside along each transport line, each connecting strand 24 communicating on one end with the atomizer housing 2 and on the other with the respective nozzle 6 or terminates in the interior of the respective nozzle 6. The metal connecting strand 24 may for example be embedded in the form of steel wire in a transport line 4 made of a plastic material. In the drawing, the metal connecting strand 24 extends along the circumference of the transport line 4. Each metal connecting strand 24 is suitable for transmitting the vibrations produced onto the fluid in the individual nozzles 6.

In another embodiment, shown on the right in FIG. 2, the transport lines 4 are made of an extensible material and each metal connecting strand 24*a*, which transmits vibrations, communicates with the ultrasonic vibrator 22 on one end and on the other end with a respective nozzle 6. It is also adequate if the end of the connecting strand 24*a* remote from the ultrasonic vibrator merely protrudes into the fluid inside each nozzle 6.

In the embodiment shown on the left in FIG. 2, the transport line 4 is likewise made of extensible material, and a metal connecting strand 24*b* that transmits vibrations communicates on one end with the vibration plate 23 of the ultrasonic vibrator 22 and on the other with a nozzle 6. The connecting strands 24*a* and 24*b* are preferably guided inside the transport lines 4. It is again adequate if the end of the connecting strand 24*b* remote from the vibration plate 23 merely protrudes into the fluid located in each nozzle 6.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. An ultrasonic atomizer system for liquids, in particular for atomizing fuel to be injected into internal combustion engines, having an atomizer housing (2) which receives liquid under pressure and an ultrasonic vibrator (22) acting upon the liquid emerging from the atomizer housing, a plurality of transport lines (4), that communicate with the atomizer housing (2), which carries fluid from the atomizer housing (2) to separate nozzles (6) disposed on the other end of each transport line (4), each of said nozzles having at least one injection port (8), and vibrations originating in the ultrasonic vibrator (22) also act upon the fluid inside each nozzle (6).

2. An ultrasonic atomizer system as defined by claim 1, in which each transport line (4) is made of a material that transmits vibrations.

3. An ultrasonic atomizer system as defined by claim 1, in which each transport line (4) is made of an extensible material, and includes a metal connecting strand (24*a*, 24*b*) that communicates with the ultrasonic vibrator (22, 23) and leads to each nozzle (6) to transmit vibrations to each nozzle (6).

4. An ultrasonic atomizer system as defined by claim 3, in which the connecting strand (24*b*) communicates at one end with the vibration plate (23) of the ultrasonic vibrator (22).

5. An ultrasonic atomizer system as defined by claim 3, in which each connecting strand (24*a*, 24*b*) extends to said nozzles inside said transport lines (4).

6. An ultrasonic atomizer system as defined by claim 4, in which each connecting strand (24*a*, 24*b*) extends to said nozzles inside said transport lines (4).

7. An ultrasonic atomizer system as defined by claim 1, characterized in which each transport line (4) is made of extensible material, and a metal connecting strand (24) that transmits vibrations extends along each transport line (4), the connecting strand communicating with the atomizer housing (2) and each connecting strand leading to one of the nozzles (6).

8. An ultrasonic atomizer system as defined by claim 1, in which each nozzle (6) has a plurality of injection ports (8) of equal diameter ($d_G$), and the vibrations acting upon the streams of fluid emerging from the injection ports (8) have a wavelength (λ) that leads to a disintegration of the emerging fluid streams, forming droplets (9) of equal diameter ($d_T$).

9. An ultrasonic atomizer system as defined by claim 1, wherein each nozzle (6) discharges into an air intake tube (5) upstream of each inlet valve of an internal combustion engine.

10. An ultrasonic atomizer system as defined by claim 2, wherein each nozzle (6) discharges into an air intake tube (5) upstream of each inlet valve of an internal combustion engine.

11. An ultrasonic atomizer system as defined by claim 3, wherein each nozzle (6) discharges into an air intake tube (5) upstream of each inlet valve of an internal combustion engine.

12. An ultrasonic atomizer system as defined by claim 4, wherein each nozzle (6) discharges into an air intake tube (5) upstream of each inlet valve of an internal combustion engine.

13. An ultrasonic atomizer system as defined by claim 5, wherein each nozzle (6) discharges into an air intake tube (5) upstream of each inlet valve of an internal combustion engine.

14. An ultrasonic atomizer system as defined by claim 6, wherein each nozzle (6) discharges into an air intake tube (5) upstream of each inlet valve of an internal combustion engine.

15. An ultrasonic atomizer system as defined by claim 7, wherein each nozzle (6) discharges into an air intake tube (5) upstream of each inlet valve of an internal combustion engine.

16. An ultrasonic atomizer system as defined by claim 8, wherein each nozzle (6) discharges into an air intake tube (5) upstream of each inlet valve of an internal combustion engine.

* * * * *